US005590213A

United States Patent [19]

Urella et al.

[11] Patent Number: 5,590,213

[45] Date of Patent: Dec. 31, 1996

[54] HEADSET WITH ADJUSTABLE HEADPAD

[75] Inventors: Richard M. Urella, Charlton; Glen A. Davis, Leominster, both of Mass.

[73] Assignee: David Clark Company Inc., Worcester, Mass.

[21] Appl. No.: 388,740

[22] Filed: Feb. 15, 1995

[51] Int. Cl.[6] ..... H04R 25/00

[52] U.S. Cl. ..... 381/183; 381/187

[58] Field of Search ..... 381/183, 187, 381/25, 188, 205; 181/129, 137; 379/430; 29/594

[56] References Cited

U.S. PATENT DOCUMENTS

| | | |
|---|---|---|
| D. 246,242 | 11/1977 | Bellini . |
| D. 254,183 | 2/1980 | Doodson . |
| D. 258,430 | 3/1981 | Hayashi . |
| D. 299,025 | 12/1988 | Besasie . |
| D. 302,429 | 7/1989 | Leer . |
| 1,556,792 | 10/1925 | Jones . |
| 1,714,377 | 5/1929 | Kiernan . |
| 2,191,055 | 2/1940 | Wenzky . |
| 2,235,372 | 3/1941 | Kalbitz . |
| 2,408,494 | 10/1946 | Veneklasen . |
| 2,989,598 | 6/1961 | Touger et al. . |
| 2,990,553 | 7/1961 | Ulrich et al. . |
| 3,030,458 | 4/1962 | Gongoll . |
| 3,051,961 | 9/1962 | Clark . |
| 3,052,887 | 9/1962 | Sockel et al. . |
| 3,073,410 | 1/1963 | Gongoll et al. . |
| 3,220,505 | 11/1965 | Hargrave . |
| 3,391,407 | 7/1968 | Waters . |
| 3,408,658 | 11/1968 | Beguin et al. . |
| 3,457,565 | 7/1969 | Simpson et al. . |
| 3,555,207 | 1/1971 | Cech . |
| 3,571,813 | 3/1971 | Allen . |
| 3,593,341 | 7/1971 | Aileo . |
| 3,686,691 | 8/1972 | Anderson . |
| 3,796,855 | 3/1974 | Brown et al. . |
| 3,862,451 | 1/1975 | Miller et al. . |
| 3,908,200 | 9/1975 | Lundin . |
| 3,992,720 | 11/1976 | Nicolinas . |
| 4,071,717 | 1/1978 | Fidi et al. . |
| 4,087,653 | 5/1978 | Frieder, Jr. et al. . |
| 4,138,598 | 2/1979 | Cech . |
| 4,139,743 | 2/1979 | Flygstad . |
| 4,156,118 | 5/1979 | Hargrave . |
| 4,160,135 | 7/1979 | Görike . |
| 4,189,788 | 2/1980 | Schenke et al. . |
| 4,302,635 | 11/1981 | Jacobsen et al. . |
| 4,456,642 | 6/1984 | Burgdörfer et al. . |
| 4,471,496 | 9/1984 | Gardner, Jr. et al. . |
| 4,472,607 | 9/1984 | Houng . |
| 4,499,593 | 2/1985 | Antle . |
| 4,551,584 | 11/1985 | Mathiasen . |
| 4,572,323 | 2/1986 | Randall . |
| 4,588,868 | 5/1986 | Bertagna et al. . |
| 4,674,134 | 6/1987 | Lundin . |
| 4,747,145 | 5/1988 | Wiegel . |
| 4,771,454 | 9/1988 | Wilcox, Jr. . |
| 4,783,822 | 11/1988 | Toole et al. . |
| 4,856,118 | 8/1989 | Sapiefewski . |
| 4,875,233 | 10/1989 | Derhaag et al. . |
| 4,905,322 | 3/1990 | Aileo et al. . |

(List continued on next page.)

FOREIGN PATENT DOCUMENTS

| | | | |
|---|---|---|---|
| 2643157 | 4/1978 | Germany | 381/183 |

*Primary Examiner*—Sinh Tran

*Attorney, Agent, or Firm*—Samuels, Gauthier, Stevens & Reppert

[57] ABSTRACT

An adjustable headpad assembly is disclosed for use in a headset of the type having a resilient headband with a bridge portion configured to overlie a user's head and leg portions depending from the bridge portion to stirrups carrying earcups configured and dimensioned to enclose a user's ears. The adjustable headpad assembly includes slide members carried on and moveable along the leg portions, a cushioning element extending between the leg portions and connected at opposite ends to the slide members, and a latch unit. The latch unit is releasable to accommodate movement of the slide members along the leg portions to selected positions of adjustment, and is engageable to fix the slide members at the selected positions.

7 Claims, 3 Drawing Sheets

U.S. PATENT DOCUMENTS 4,944,361 7/1990 Lindgren et al. .
4,958,697 9/1990 Moody .
4,987,592 1/1991 Flagg .
4,989,271 2/1991 Sapiefewski et al. .
4,999,846 3/1991 Ball et al. .
5,003,631 4/1991 Richardson .
5,018,599 5/1991 Dohi et al. .
5,020,163 6/1991 Aileo et al. .
5,023,955 6/1991 Murphy, II et al. .
5,117,464 5/1992 Jones et al. .
5,138,722 8/1992 Urella et al. .
5,229,364 3/1994 Mirmilshteyn et al. .
5,241,971 9/1993 Lundin .

HEADSET WITH ADJUSTABLE HEADPAD

BACKGROUND OF THE INVENTION

The invention relates to circumaural headsets having ear domes adapted to attenuate noise. Such headsets include not only communication equipment but also ear protectors and other like noise attenuating devices.

Circumaural headsets function by enclosing the ears of a user within earcups, typically plastic domes. The earcups are typically attached to a spring and suspension headband assembly which applies a force urging the earcups against the head of the user. Proper adjustment of the headband clamping force is critical to achieving optimum comfort and noise attenuation levels. Excessive force can cause discomfort, whereas insufficient force can result in an inadequate earcup seal allowing ambient noise to penetrate the ear dome cavity.

The weight of the headset may be supported by the clamping force applied to the earcups, although this typically involves the use of an excessive force causing discomfort. It is generally preferred that at least a portion of the weight of the headset be supported by the headband. In this case, the length of the headband is typically adjustable to ensure that the user's ears are properly enclosed. This requires, however, that any electrical wires extending from one earcup to another be sufficiently long to permit the headband to fully extend. When not fully extended, the one or more wires typically include a slack portion that bulges from the headset and may become ensnared on other equipment. It is an object of the present invention to provide an adjustable headset that includes a fixed wire length between the earcups.

Further, if any of the weight of the headset is supported by a portion of the headband, then the portion of the headset that contacts the user's head must also be comfortable and sufficiently conform to the user's head to ensure a proper fit. It is also an object of the invention to provide an adjustable headset that offers superior comfort and is aesthetically pleasing in appearance.

SUMMARY OF THE INVENTION

The invention provides an adjustable headpad assembly for use in a headset of the type having a resilient headband with a bridge portion configured to overlie a wearer's head, and leg portions depending from the bridge portion to stirrups carrying earcups configured and dimensioned to enclose a wearer's ears.

The adjustable headpad assembly includes slide members carried on and moveable along the leg portions, a cushioning element extending between the leg portions and connected at opposite ends to the slide members, and a latch unit associated with each slide member and engageable with a respective leg portion of the headband. Each, latch unit is releasable to accommodate movement of its associated slide member along a respective leg portion to a selected position of adjustment, and is engageable to fix the slide member at the selected position.

In various embodiments, the headpad assembly includes elastomeric components for biasing the position of the headpad with respect to the earcups, and releasable snaps for facilitating removal of the headpad assembly from the headset. The cushioning element may include a composite of a plurality of types of foams.

BRIEF DESCRIPTION OF THE DRAWINGS

The following description of the preferred embodiments of the invention will be further understood with reference to the accompanying drawings in which.

DETAILED DESCRIPTION OF THE ILLUSTRATED EMBODIMENTS

Figure 1:
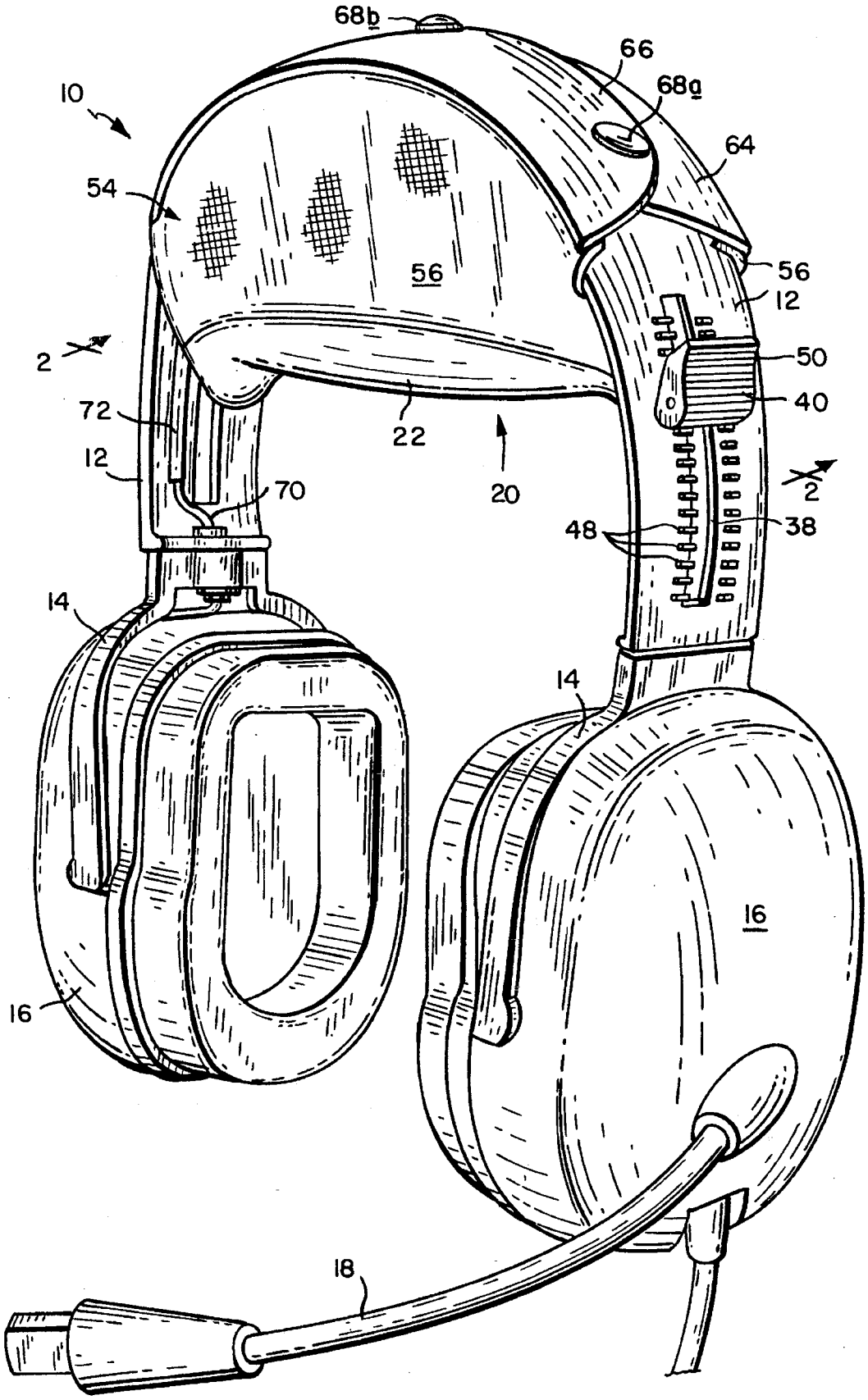
FIG. 1 is an isometric view of a headset in accordance with a preferred embodiment of the invention.

As shown in FIG. 1 a headset 10 of the invention includes a headband 12 and stirrups 14 depending from either end of the headband 12 for carrying earcups 16 that are adapted to enclose a user's ears. One of the earcups includes a microphone boom assembly 18 as shown, and both earcups include internal speaker units (not shown).

Figure 2:
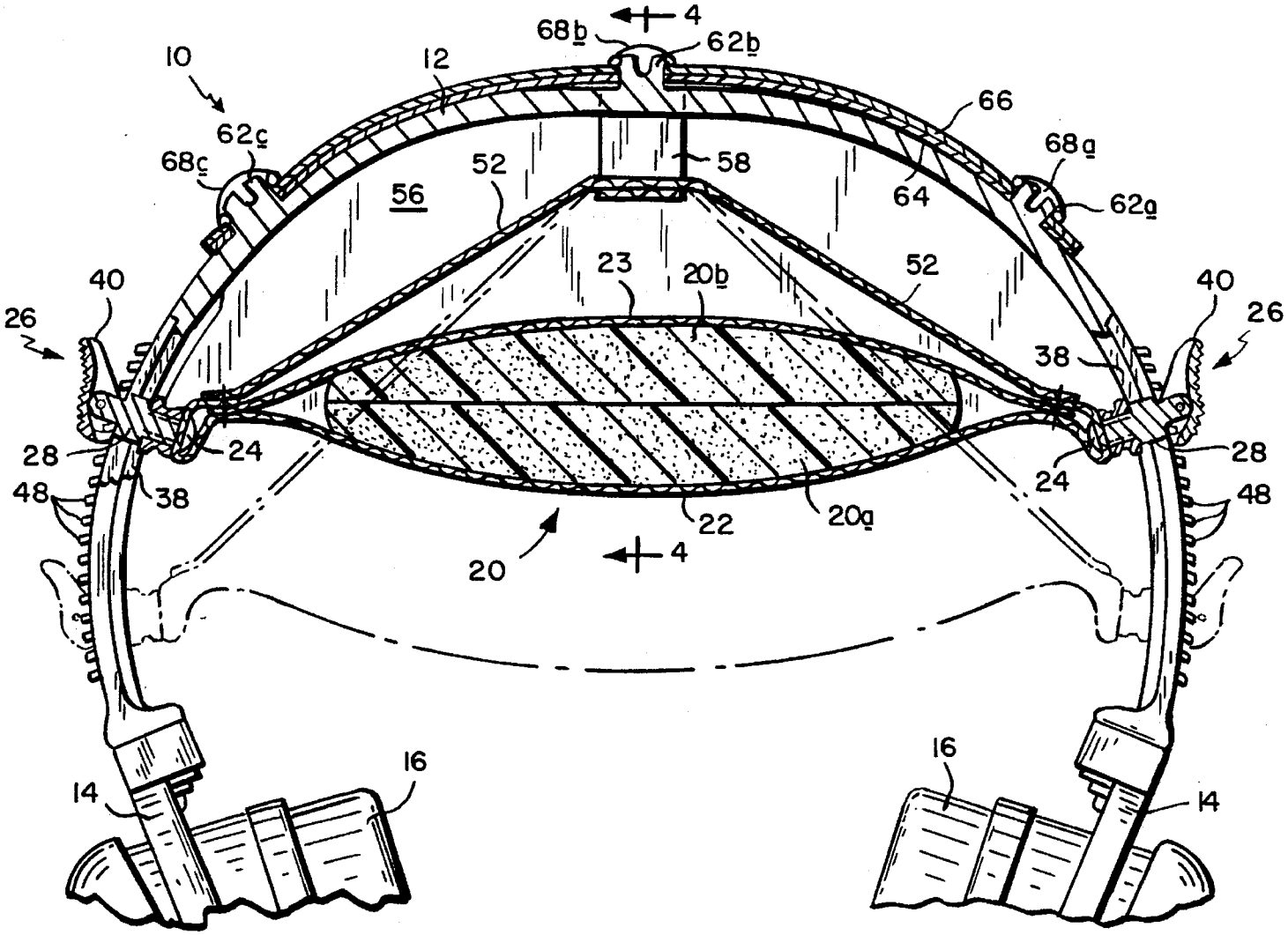
FIG. 2 is a partial sectional view of the headset shown in FIG. 1 taken along line 2—2 thereof.
Figure 4:
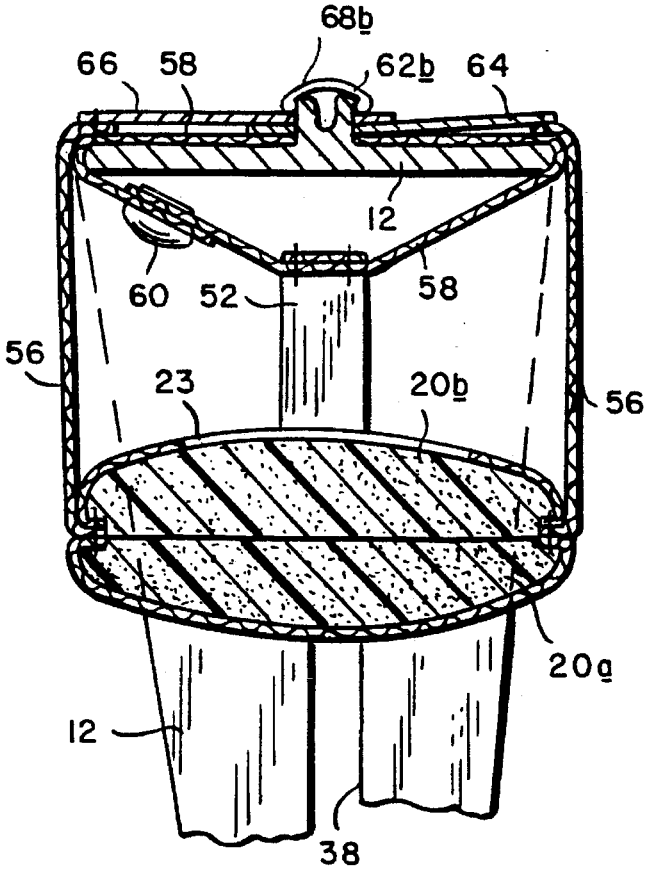
FIG. 4 is a partial sectional view of the headset taken along line 4—4 of FIG. 2.

As shown in FIG. 2, the headset 10 further includes a composite headpad 20 enclosed within an elongated elastomeric headpad envelope 22 that is attached at either end via female button snap elements 24 to slide members 26. In the illustrated embodiment the headpad includes two soft foam pads 20*a* and 20*b* that are glued together. One of the foam pads, 20*b*, comprises a slow recovery urethane foam. The composite headpad 20 may be inserted into the envelope 22 through slit 23 as shown in FIGS. 2 and 4.

Figure 3A:
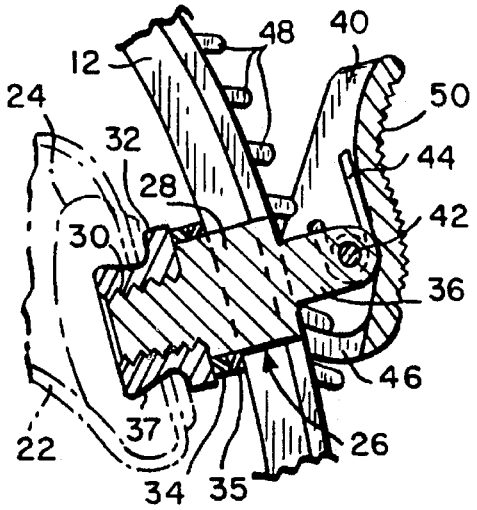
FIGS. 3A and 3B are views of a portion of the headset shown in FIG. 2 on an enlarged scale showing a slide member with its latch unit; in the engaged and disengaged conditions respectively.
Figure 3B:
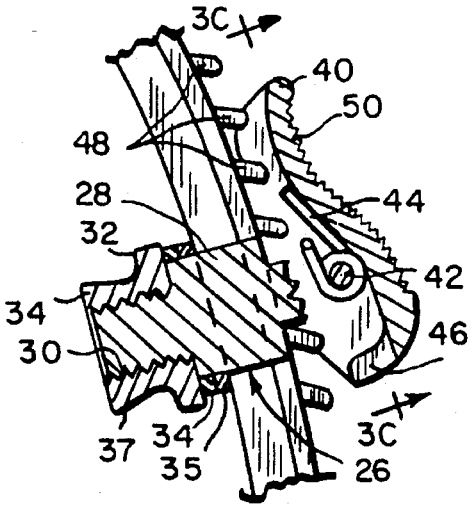
Figure 3C:
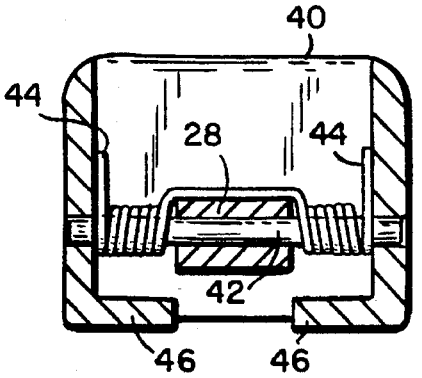
FIG. 3C is a sectional view of the latch unit shown in FIG. 3B taken along line 3C—3C thereof.

As shown in FIGS. 2, and 3A–3B, each slide member 26 includes a post 28 that is threaded at one end 30 and adapted to receive a nut 32 thereon. Integrally formed with each nut 32 is a male button snap element 34 for attachment to a snap element 24 as shown in FIGS. 2, and 3A–3B. The other end 36 of each post 28 is received through a longitudinally extending slotted track 38 in the headband 12 and is attached to a latch element 40 on the opposite side of the headband 12. As shown in FIGS. 3A and 3B, one or more washers 35, 37 may be positioned between the nut 32 and the inner surface of the headband 12. In a preferred embodiment, a plastic washer 35 is positioned adjacent the inner surface of the headband 12 to facilitate the sliding of the member 26 along the slotted track 38, and a rubber washer 37 is positioned between the plastic washer and the nut 32 for securing the nut 32 on the post 28 without binding the movement of the member 26. As shown in FIGS. 3A–3C, the latch element 40 is rotatably mounted on a transverse pin 42 extending through on the post 28. The rotational position of the latch element 40 is biased by a spring 44 to favor a locked position in which the bottom edge 46 of the latch element 40 engages teeth 48 on opposite sides of the slotted 38 track in the headband 12. In the locked position the latch element 40 restrains the member 26 from sliding along the length of the slotted track 38.

The latch element 40 may be unlocked by manually depressing the concave exterior surface 50 of the element 40 to counteract the force of the spring 44 as shown in FIG. 3B. In the unlocked position, each latch element 40 permits its associated slide member 26 to be freely moved along the length of the slotted track 38 to thereby adjust the position of the headpad 20 with respect to the earcups 16. The surface 50 of each latch element 40 may include ridges as shown to facilitate gripping during actuation and adjustment.

As shown in FIG. 2 the headpad 20 and envelope 22 are suspended by an elastomeric band 52 and these components are enclosed within a sleeve 54 having elastomeric side walls 56 as shown in FIG. 1. The side walls 56 are attached to the longitudinal sides of the envelope 22 via stitching as shown in FIG. 4. The band 52 is attached via stitching at an upper central portion to a non-elastomeric strap 58 that encircles a portion of the headband 12 as shown in FIGS. 2 and 4. The ends of the strap 58 are joined together by means of a button snap 60. The headband 12 includes three male button snap elements 62*a*—62*c* as shown in FIG. 2, and the strap 58 further includes an opening for receiving the centrally located male snap element 62*b* as shown in FIG. 4.

As shown in FIGS. 1 and 4, the sleeve 54 further includes two non-elastomeric overlapping top flaps 64 and 66 attached to the elastomeric side walls 56 via stitching as shown in FIG. 4. The first top flap 64 includes three openings for receiving the male snap elements 62*a*–62*c* as shown in FIGS. 2 and 4, and the second top flap 66 includes female button snap elements 68*a* —68*c* for engaging the male snap elements 62*a*–62*c* respectively as shown in FIGS. 1, 2 and 4.

In use, the latch elements 40 may be unlocked as described above and the slide members 26 moved along slotted the tracks 38 to their uppermost positions away from the earcups 16. The headset 10 is then placed on the user's head and the slide members 26 are lowered (as shown in phantom in FIG. 2) until the headpad 20 is secured against the top of the user's head properly positioning the headset 10 on the user. The position of the headpad 20 is secured by releasing the latch elements 40 thereby permitting the bias springs to cause the bottom edges 46 of the latch elements to engage the teeth 48 on the headband 12.

The elastomeric band 52 and the elastomeric sleeve walls 56 stretch as the slide members 26 and headpad 20 are lowered from their uppermost positions. The band 52 and walls 56 therefore present a biasing force facilitating the movement of the slide members 26 in the upward direction. This biasing force also helps maintain the secured engagement of the latch elements 40 with the teeth 48. Due to the use of the snaps 24/26, 62/68 and 60, the headpad assembly may be easily removed for cleaning and/or replacement.

Any wires 70 that extend from one earcup to the other may be secured in tracks 72 that run along the inside surface of the headband as partially shown in FIG. 1. Since the length of the headband does not change during use, the headset provides a fixed wire length between the earcups thus eliminating the need for oversized wires.

Those skilled in the art will appreciate that numerous modifications and variations may be made to the above described embodiments without departing from the spirit and scope of the invention.

We claim:

1. For use in a headset of the type having a resilient headband with a bridge portion configured to overlie a user's head and leg portions extending from said bridge portion to stirrups carrying earcups configured and dimensioned to enclose a user's ears, an adjustable headpad assembly comprising:

slide members carried on and moveable along said leg portions;

a cushioning element extending between said leg portions and connected at opposite ends to said slide members;

latch means associated with said slide members and said leg portions, said latch means being releasable to accommodate movement of said slide members along said leg portions to selected positions of adjustment, and being engageable to fix said slide members at said positions; and headpad biasing means for resiliently urging said slide members towards the bridge portion of said headband, said headpad biasing means including an elastomeric sheath enclosing said cushioning element and said bridge portion.

2. The adjustable headpad assembly of claim 1 wherein said latch means comprises toothed racks extending along said leg portions, and latch members carried on said slide members for pivotal movement into and out of engagement with said racks.

3. The adjustable headpad assembly of claim 2 further comprising spring means for biasing said latch members into engagement with said racks.

4. The adjustable headpad assembly of claim 1, wherein:

said leg portions of said headband further include tracks along which said slide members are adapted to slide, and teeth along at least portions of said tracks, said slide members each including a latch member for engaging said teeth; and biasing means for biasing said latch members into engagement with said teeth.

5. For use in a headset of the type having a resilient headband with a bridge portion configured to overlie a user's head and leg portions extending from said bridge portion to stirrups carrying earcups configured and dimensioned to enclose a user's ears, an adjustable headpad assembly comprising:

slide members carried on and moveable along said leg portions;

a cushioning element extending between said leg portions and connected at opposite ends to said slide members;

securing means associated with said slide members and said leg portions, said securing means being operative to accommodate movement of said slide members along said leg portions to selected positions of adjustment, and to secure said slide members at said positions; and headpad biasing means for resiliently urging said slide members towards the bridge portion of said headband, said headpad biasing means including an elastomeric sheath enclosing said cushioning element and said bridge portion.

6. The adjustable headpad assembly as claimed in claim 1 or 5, wherein said elastomeric sheath is formed integrally with said cushioning element and includes releasable snaps for attachment to the bridge portion of said headband.

7. The adjustable headpad assembly as claimed in claims 1 or 5, wherein said headpad biasing means further includes an elastomeric band extending from each of said slide members to the bridge portion of said headband.

* * * * *